United States Patent [19]

Hiki et al.

[11] 4,301,725

[45] Nov. 24, 1981

[54] PRINTING APPARATUS WITH ABRASION RESTRAINER

[75] Inventors: Toshio Hiki; Koichi Saga, both of Katsuta, Japan

[73] Assignee: Hitachi Koki Company, Limited, Tokyo, Japan

[21] Appl. No.: 57,493

[22] Filed: Jul. 13, 1979

[30] Foreign Application Priority Data

Jul. 14, 1978 [JP] Japan ..... 53-86422

[51] Int. Cl.[3] ..... B41J 1/20

[52] U.S. Cl. ..... 101/93.14; 101/111; 184/17; 474/91

[58] Field of Search ..... 101/93.14, 106, 111; 184/110, 12, 15 R, 17, 101; 74/230, 257, 467

[56] References Cited

U.S. PATENT DOCUMENTS

| | | | |
|---|---|---|---|
| 517,553 | 4/1894 | Nelson | 184/17 |
| 2,678,112 | 5/1954 | McDaniel | 184/15 R |
| 2,909,937 | 10/1959 | Williams | 74/230 |
| 3,053,371 | 9/1962 | Fischer | 184/15 R X |
| 3,633,500 | 1/1972 | Edwards et al. | 101/111 |
| 3,845,711 | 11/1974 | Helms | 101/111 |
| 4,177,727 | 12/1979 | Cooke et al. | 74/257 X |

FOREIGN PATENT DOCUMENTS

| | | | |
|---|---|---|---|
| 2712998 | 10/1978 | Fed. Rep. of Germany | 101/111 |

*Primary Examiner*—Edward M. Coven

*Attorney, Agent, or Firm*—Lowe, King, Price & Becker

[57] ABSTRACT

A sleeve member of elastomeric material is mounted on one of the driving and driven pulleys between which the type-carrier is passed. The sleeve member is wetted with a lubricant liquid so that a friction occurring between the type-carrier and the platen is minimized.

6 Claims, 3 Drawing Figures

PRINTING APPARATUS WITH ABRASION RESTRAINER

FIELD OF THE INVENTION

The present invention relates in general to printing apparatus and more particularly to a printing apparatus, such as a line printer, including a longitudinally movable type-carrier, a movable inked ribbon, a plurality of printing hammers striking a print sheet against the inked ribbon, and a platen against which the type-carrier is pressed at the striking of the printing hammers against the print sheet

OBJECTS OF THE INVENTION

It is an object of the present invention to provide a printing apparatus having means by which unwanted abrasion of the platen and the type-carrier due to sliding contact therebetween upon operation of the printing apparatus becomes minimized.

It is another object of the present invention to provide a printing apparatus which assures high speed and high quality printing.

It is still another object of the present invention to provide a printing apparatus which is constructed by slightly modifying a part of a conventionally used line printer.

According to the present invention, there is provided a printing apparatus which comprises a longitudinally movable type-carrier having on one face thereof a series of type characters, an inked ribbon movable in front of the type characters of the type-carrier, a plurality of printing hammers for striking a print sheet to force the same against the inked ribbon for impression of characters on the print sheet in ink, a platen having a face to which the other face of the type-carrier is contactable at least at the striking of the printing hammers against the print sheet, and a lubricant liquid supplying means which continuously wets the other face of the type-carrier with a lubricant liquid upon the longitudinal movement of the type carrier.

Other objects and advantages of the present invention will become clear from the following description when taken in conjunction with the accompanying drawings.

DESCRIPTION OF A PRINTING APPARATUS TO WHICH THE INVENTION IS APPLICABLE

Prior to describing in detail the invention, outlined explanation of the overall construction of a printing apparatus to which the invention is applicable will be made with reference to FIGS. 1 and 2. This type printing apparatus is clearly shown in U.S. patent application Ser. No. 909,106.

Figure 1:
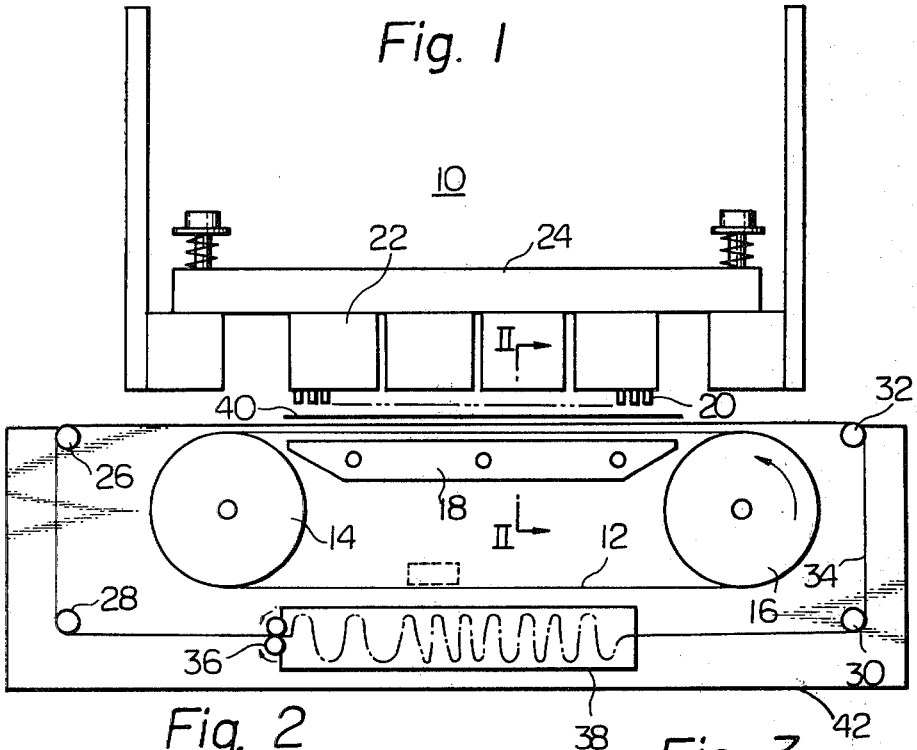
FIG. 1 is a schematic plan view of a printing apparatus to which the present invention is applicable.
Figure 2:
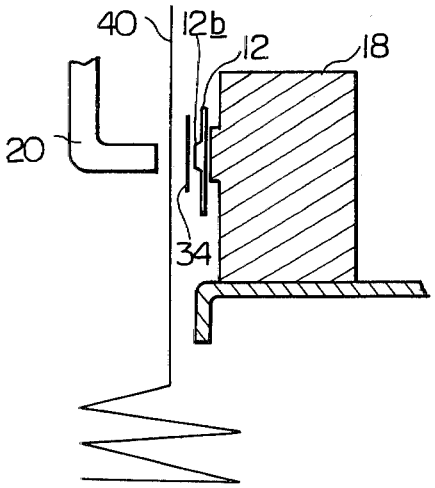
FIG. 2 is an enlarged sectional view taken along the line II-II of FIG. 1.

Referring to FIGS. 1 and 2, especially FIG. 1, a printing apparatus to which the invention is applicable is illustrated as being generally designated by reference numeral 10. The printing apparatus 10 comprises a type-carrier 12 constructed by, for example, a flexible endless stainless steel belt 12*a* having a series of type characters

Figure 3:
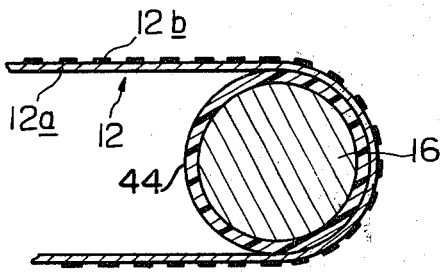
FIG. 3 is a view of a driven pulley equipped with a lubricant liquid applying means, embodying the present invention.

12*b* formed on the outer face of the belt 12*a* (see FIG. 3). The type-carrier 12 is passed between a driving pulley 14 and a driven pulley 16 to travel horizontally about these pulleys 14 and 16. Although not shown in the drawings, the peripheral surface of each pulley 14 or 16 is covered with an elastomeric film, such as a polyurethane resin film, for assuring a frictional engagement between each of the pulleys 14 and 16 and the belt 12*a*. Inside the endless type-carrier 12 is located a platen or anvil 18 which extends straightly along a printing zone which is positioned along one of the straightly extending paths of the type-carrier 12. The face of the platen 18 is metal-coated for hardening of the same. Usually, chrome-plating or nickel-plating is employed. Located outside of the type-carrier 12 is a plurality of printing hammers 20 (only one of which is numbered) which are juxtaposed in a row along the printing zone in a manner to face the face of the platen 18. These hammers 20 are arranged in groups on hammer actuating units 22 which are connected to a fixed hammer bank 24. Designated by numerals 26, 28, 30 and 32 are spacedly arranged guide rollers between which an endless inked ribbon 34 is passed in a manner to cause a part thereof to run horizontally along the printing zone between the row of the printing hammers 20 and the endless type-carrier 12. A pair of pinch-rollers 36 is arranged in the path of the inked ribbon 34 to lead the ribbon 34 having passed through the guide roller 28 into a cassette 38 in a folded or otherwise compactly packed condition, as shown. A print sheet or paper 40 runs vertically, that is toward this side in FIG. 1, between the row of the printing hammers 20 and the inked ribbon 34. Denoted by numeral 42 is a yoke plate or base plate on which parts such as the parts 14, 16, 18 and 38 are mounted.

In operation, when a character of the type-carrier 12 to be printed passes the position where it is to be printed, the corresponding printing hammer 20 is actuated to strike the print sheet 40 forcing the same against the type at that position via the inked ribbon 34, so that the character is impressed on the print sheet 40 in ink.

In the above-described printing apparatus, however, there arises a problem in which a considerable abrasion appears at both the face (metal-coated face) of the platen 18 and the inner face of the type-carrier 12 in a shorten period of working time of the printer. This abrasion is caused by the strong contact of the type-carrier 12 to the face of the platen 18, occurring when the printing hammers 20 strike the print sheet 40 forcing the type-carrier 12 against the platen 18. It is found that such abrasion becomes greater as the running speed of the type-carrier 12 increases. It is obvious that such abrasion causes not only poor printing quality but also shortening of lives of the type-carrier 12 and the platen 18.

DESCRIPTION OF THE EMBODIMENTS OF THE INVENTION

It is therefore an essential object of the invention to solve the above-mentioned problem. The object is attained by continuously feeding the inner face of the type-carrier 12 with a lubricant liquid for reduction of frictional resistance appearing between the inner face of the type-carrier 12 and the face of the platen 18. The measure for the attainment will be clear from the following description.

Referring to FIG. 3 of the drawings, there is shown a driven pulley 16 on which a so-called lubricant liquid supplying means is mounted, which embodies the invention. As will be seen from the drawing, the peripheral surface of the driven pulley 16 is covered with an oil-resistant elastomeric sleeve 44, such as a silicone rubber sleeve or a polyamide resin sleeve (nylon), which is wetted with a lubricant liquid such as a silicone oil. When using a silicone rubber sleeve and a silicone oil, about 5 to 7% oil by weight may be contained in the sleeve 44. Further, if desired, foam materials such as a polyurethane resin foam and a rubber foam or oleo-resin may be used for the sleeve 44. The fixing of the sleeve 44 to the peripheral surface of the pulley 16 is made by suitable bonding technique, such as sleeve melting method or the like. The selection of the lubricant liquid is such made that it does not worsen the properties of materials forming the pulley 16 and the belt 12*a* of the type-carrier 12. Mineral oil (machine oil) and silicone oil are thus available for such liquid. If desired, the sleeve 44 may be applied to the driving pulley 14 instead of to the driven pulley 16, furthermore both of the pulleys 14 and 16 may be equipped with such sleeves. In addition, the platen 18 may be constructed of ceramics or polyamide resin without being metal-coated.

With the construction mentioned above, the lubricant liquid oozes out of the sleeve 44 and wets the inner face of the belt 12*a* of the type-carrier 12 continuously under running of the type-carrier 12 around the pulley 16. The lubricant liquid thus transferred to the belt 12*a* is moved with the belt 12*a* into the printing zone where the liquid is introduced as a film between the inner face of the belt 12*a* and the face of the platen 18. Thus, the friction between these faces is reduced thereby minimizing the undesired abrasion therebetween.

Although in the foregoing description, it is described that the lubricant liquid supply means is equipped on the pulley 14 or 16 or on the pulleys 14 and 16, such means may be located at the path of the type-carrier 12, for example, at the position indicated by broken lines.

Furthermore, the lubricant liquid supplying means of the present invention is applicable to another type printing apparatus such as one including an inked ribbon which is vertically movable with respect to the horizontally movable type-carrier.

Thus, according to the present invention, high speed and high quality printing is available.

What is claimed is:

1. A printing apparatus comprising:

(a) a rotatably mounted drive pulley;

(b) means for rotating said drive pulley;

(c) a rotatably mounted idler pulley;

(d) an endless type carrier belt constructed of a thin metallic plate, said endless type carrier belt being engaged with both said drive pulley and said idler pulley to move around said two pulleys, said endless type carrier belt being partially wrapped around both said drive pulley and said idler pulley and in tension between said pulleys;

(e) hammer means placed at one side of said endless type carrier belt for striking a printing sheet against faces of selected types carried by said endless type carrier belt;

(f) a platen placed at an opposite side of said endless type carrier belt; and (g) lubricating means disposed around the periphery of at least one of said drive pulley and said idler pulley in such a manner that said lubricating means rotates with the corresponding pulley, said lubricating means having an elastomeric sheet containing a lubricant;

(h) said elastomeric sheet being interposed between said at least one of said drive pulley and said idler pulley and said carrier belt, whereby pressure of said belt on said elastomeric sheet dispenses said lubricant onto said carrier belt during rotation of said pulleys, to minimize friction between said belt and said platen.

2. A printing apparatus as claimed in claim 1, wherein said elastomeric sheet is made of an oleoresin.

3. A printing apparatus as claimed in claim 1, wherein said elastomeric sheet is made of silicone rubber.

4. A printing apparatus as claimed in claim 11, wherein said lubricant liquid is silicone oil.

5. A printing apparatus as claimed in claim 4, wherein an amount of said silicone oil contained in said silicone rubber is approximately 5 to 7 percent by weight.

6. A printing apparatus as claimed in claim 1, wherein said elastomeric sheet has a ring-like shape to cover the entire peripheral surface of at least one of said drive pulley and said idler pulley.

* * * * *